US008151530B2

(12) United States Patent
Schwarz et al.

(10) Patent No.: US 8,151,530 B2
(45) Date of Patent: Apr. 10, 2012

(54) SIMULATED MASONRY WALL PANEL WITH IMPROVED INTERLOCK SYSTEM

(75) Inventors: Stefan Helmut Schwarz, Coral Springs, FL (US); Robert Trabue, Hollywood, FL (US)

(73) Assignee: Exteria Building Products, LLC, Miami, FL (US)

( * ) Notice: Subject to any disclaimer, the term of this patent is extended or adjusted under 35 U.S.C. 154(b) by 131 days.

(21) Appl. No.: 12/511,623

(22) Filed: Jul. 29, 2009

(65) Prior Publication Data

US 2011/0023396 A1 Feb. 3, 2011

(51) Int. Cl.
*E04D 1/00* (2006.01)

(52) U.S. Cl. ..... 52/314; 52/520; 52/555

(58) Field of Classification Search ..... 52/314, 52/520, 555, 554, 558, 525, 537, 539, 311.2, 52/590.2

See application file for complete search history.

(56) References Cited

U.S. PATENT DOCUMENTS

| | | | | |
|---|---|---|---|---|
| 1,931,709 | A | 10/1933 | Schaffert | |
| 2,021,578 | A | 11/1935 | Odell | |
| 2,110,485 | A | 3/1938 | Hunt | |
| 2,200,649 | A | 5/1940 | Wardle | |
| 2,209,283 | A | 7/1940 | Ronzone | |
| 2,331,796 | A * | 10/1943 | Odell | 52/515 |
| 2,359,845 | A * | 10/1944 | Harshberger | 52/314 |
| 2,592,244 | A * | 4/1952 | Chamberlain | 52/515 |
| 3,484,267 | A * | 12/1969 | Sadler | 52/518 |
| 3,518,799 | A * | 7/1970 | Bachner | 52/309.1 |
| 3,613,326 | A | 10/1971 | Mollman | |
| 3,621,625 | A | 11/1971 | Medow | |
| 3,646,715 | A | 3/1972 | Pope | |
| 3,908,326 | A | 9/1975 | Francis | |
| 3,968,610 | A | 7/1976 | Medow | |
| 4,223,490 | A | 9/1980 | Medow | |
| 4,241,554 | A | 12/1980 | Infantino | |
| 4,288,959 | A * | 9/1981 | Murdock | 52/518 |
| 4,327,528 | A | 5/1982 | Fritz | |
| 4,522,002 | A | 6/1985 | Davis et al. | |
| 4,589,241 | A | 5/1986 | Volpenhein | |
| 5,094,058 | A * | 3/1992 | Slocum | 52/533 |
| 5,347,784 | A * | 9/1994 | Crick et al. | 52/520 |
| 5,537,792 | A * | 7/1996 | Moliere | 52/531 |
| 6,170,215 | B1 | 1/2001 | Nasi | |
| 6,240,691 | B1 | 6/2001 | Holzkaemper et al. | |

(Continued)

FOREIGN PATENT DOCUMENTS

DE 3929761 A1 * 3/1991

(Continued)

*Primary Examiner* — Christine T Cajilig
(74) *Attorney, Agent, or Firm* — Drinker Biddle & Reath LLP

(57) ABSTRACT

A wall covering comprising a plurality of panels each formed with a plurality of horizontal rows of simulated building elements, such as hand laid stone separated by simulated lines of mortar. The panels have side marginal edge regions formed with hooks and side opening slots that are interengageable as an incident to relative lateral movement of the side marginal edge regions during installation, with the rows of simulated building elements in one panel, being drawn into aligned and predetermined spaced relation to the rows of building elements and adjacently mounted panel. The underlying side marginal edge region of each panel is formed with a non-planar undulating surface similar to the mortar lines throughout the panel, and the overlying side marginal edge region of each panel further is formed with a complementary undulating surface for tight mounted positioning onto the undulating surface of the underlying side marginal edge region.

18 Claims, 5 Drawing Sheets

U.S. PATENT DOCUMENTS

| | | | | |
|---|---|---|---|---|
| 6,955,019 | B2 * | 10/2005 | Donlin et al. | 52/520 |
| 7,207,145 | B2 * | 4/2007 | Stucky et al. | 52/555 |
| 2006/0191228 | A1 * | 8/2006 | Perry | 52/506.01 |
| 2008/0072514 | A1 * | 3/2008 | Barlow | 52/540 |
| 2008/0083186 | A1 * | 4/2008 | Gaudreau | 52/520 |

FOREIGN PATENT DOCUMENTS

| | | |
|---|---|---|
| EP | 0 027 569 | 9/1980 |
| PL | 62709 | 8/2003 |
| WO | WO 93/12308 | 6/1993 |

* cited by examiner

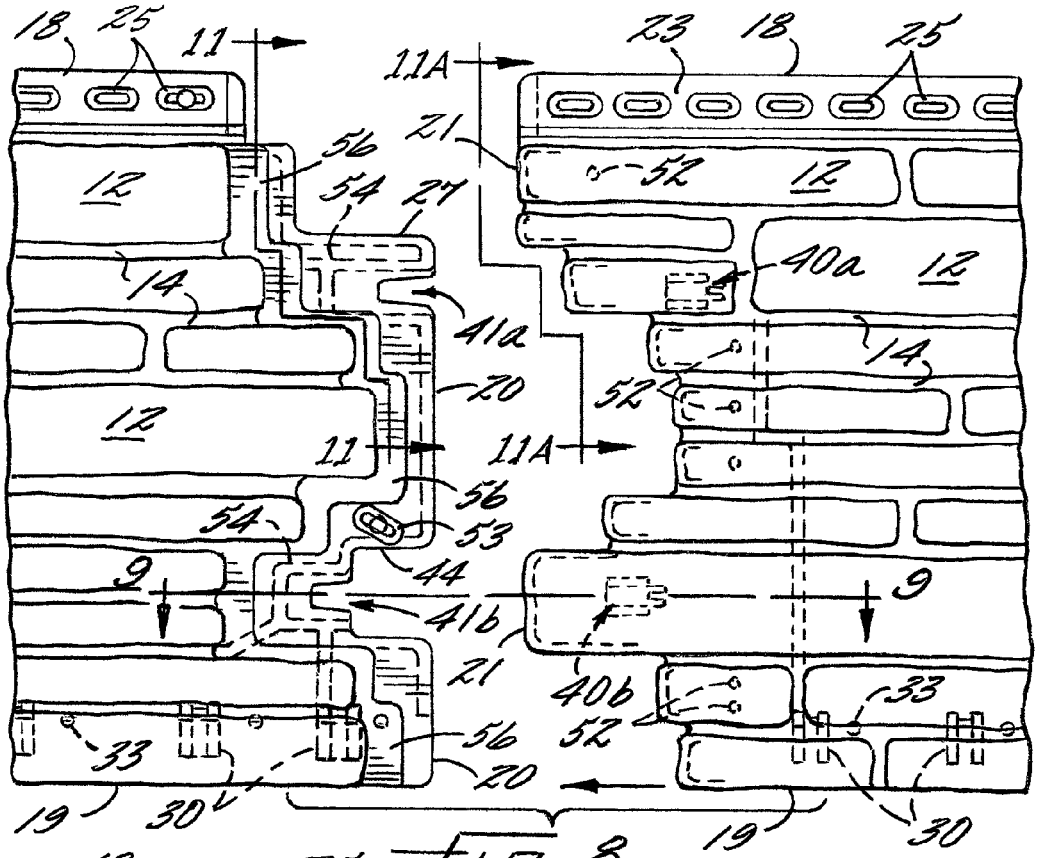
Fig. 8.
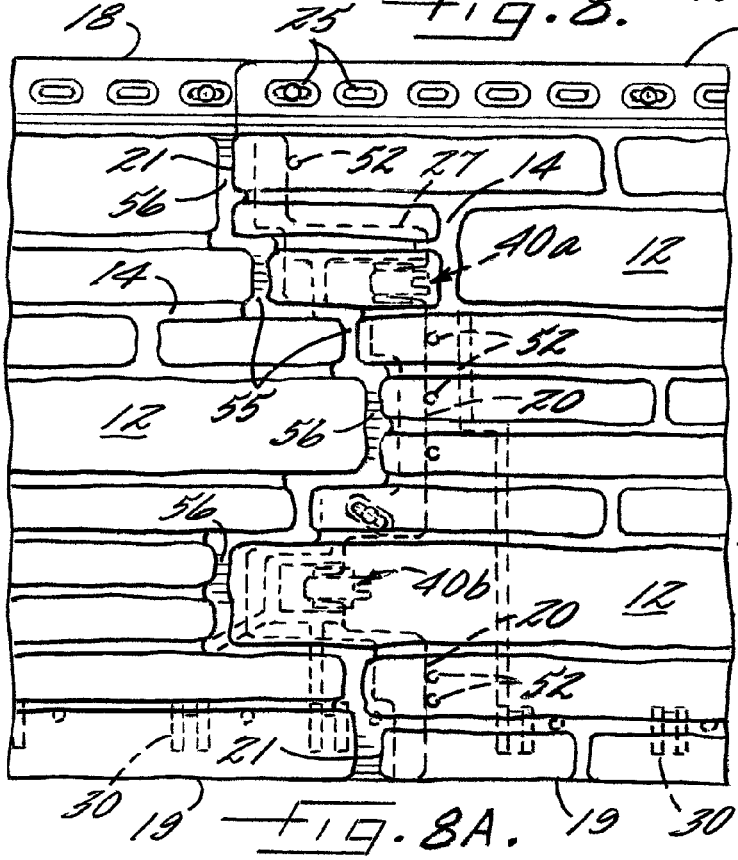
Fig. 8A.
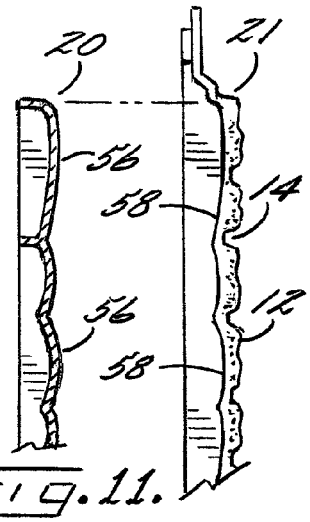
Fig. 11.
Fig. 11A.

SIMULATED MASONRY WALL PANEL WITH IMPROVED INTERLOCK SYSTEM

FIELD OF THE INVENTION

The present invention relates generally to wall and roof coverings primarily intended for outdoor usage, and more particularly, to wall coverings comprised of relatively large panels which each are molded or otherwise formed with simulated building elements, and particularly building elements in the form of simulated hand laid masonry, such as stone or brick.

BACKGROUND OF THE INVENTION

Various synthetic roof and wall coverings are known, such as those formed of elongated thermoplastic wall panels that are nailed or screwed to a wall or support surface in horizontal courses or rows in partially overlapping relation to each other so as to provide a substantially water repellant, protective layer over the support surface. Such panels, which usually are identically molded, commonly are formed with a plurality of horizontal rows of simulated building elements. Since the panels are identically molded, a panel-to-panel identity can be easily noticed if the panels are not carefully installed, which can be tedious and time consuming.

Concealing the panel-to-panel identity of panels formed with simulated hand laid stone or brick patterns has been particularly difficult. In an effort to conceal the juncture between rows of simulated masonry of adjacently mounted panels, it is known to stagger the length of the rows of the simulated masonry of each panel, and to interlock the rows of adjacent panels by forming a small slot in the underside of the masonry element of one row which receives a side flange of an adjacently mounted panel. Because of the small depth of the flange receiving slot, particularly with the shorter height simulated stone or brick, the tooling required during injection molding of the panel must be so thin that it can be subjected to warpage or breakage, causing variances in formation of the slot that can impede the precision by which the panels can be inter-engaged, resulting in unslightly and unnatural gaps between the simulated masonry of the adjacent panels. Moreover, because the simulated hand-laid stone or brick are separated by simulated mortar lines, irregular or inconsistent gaps between the stone or brick at adjoining ends of the panels that are not consistent with the mortar lines throughout the panel can be particularly noticeable.

A further problem with panels formed with such simulated masonry is that following plastic injection molding of the panel, the masonry elements and mortar lines must be separately painted. This often causes the simulated masonry to take a smooth, often shiny, appearance of the molded plastic which is not characteristic of natural stone or brick.

OBJECTS AND SUMMARY OF THE INVENTION

It is an object of the present invention to provide a wall covering comprised of panels formed with rows of simulated masonry that can be installed with a more aesthetic and natural appearance.

Another object is to provide a wall covering as characterized above in which the gaps between stone or brick masonry of adjacently mounted panels can be more tightly and precisely controlled for a more natural appearance.

Still another object is to provide a wall covering of the above kind in which the gaps between the masonry of adjacently mounted panels is defined by naturally appearing mortar lines consistent with the mortar lines separating the stone or brick masonry throughout the panels.

Yet another object is to provide a wall covering of the foregoing type in which the mortar lines between masonry of adjacently mounted panels enhances the aesthetic appearance of the juncture between the rows of simulated masonry of adjacent panels, as well as the mating engagement of the adjacent panels.

Another object is to provide a wall covering having panels of the above type which are adapted for easier installation and which enable a more robust interlocking of overlapping side marginal regions of adjacent panels.

A further object is to provide such a wall panel which facilitates precise alignment of the rows of simulated building elements of adjacent panels as an incident to installation.

Still a further object is to provide a plastic wall panel of the foregoing type which can be economically molded with more reliable and easier to use tooling.

Yet another object is to provide a plastic injection molded panel that is painted with a finishing process that gives the panel a textured surface more characteristic of natural stone or brick.

Other objects and advantages of the invention will become apparent upon reading the following detailed description and upon reference to the drawings, in which:

BRIEF DESCRIPTION OF THE DRAWINGS

FIG. 8 is an enlarged exploded view of adjacent wall panels showing the side marginal edge regions of the panels in separated relation to each other;

FIG. 8A is an enlarged plan view, similar to FIG. 8, showing the side marginal edge regions of the adjacent panels in engaged relation with each other.

FIGS. 11 and 11A are enlarged fragmentary sections taken in the planes of 11-11 and 11-11A, respectively, in FIG. 8.

Figure 1:
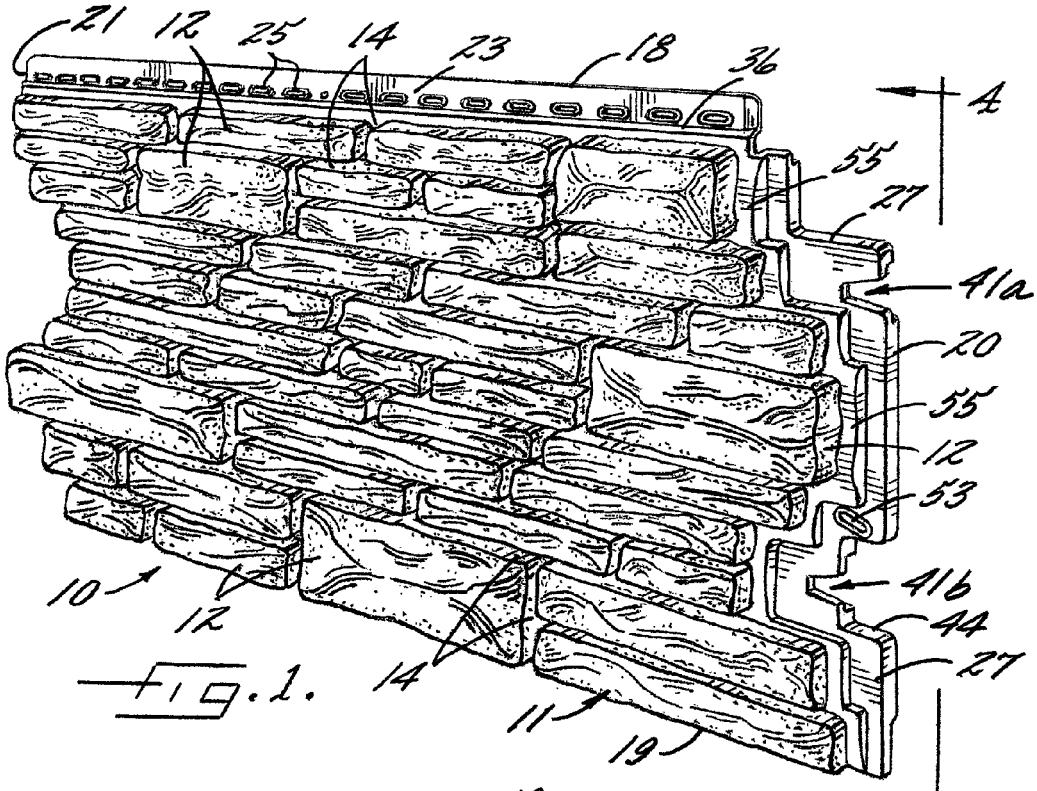
FIG. 1 is a front perspective of an illustrative wall panel in accordance with the present invention.

While the invention is susceptible of various modifications and alternative constructions, a certain illustrative embodiment thereof has been shown in the drawings and will be described below in detail. It should be understood, however, that there is no intention to limit the invention to the specific form disclosed, but on the contrary, the intention is to cover all modifications, alternative constructions, and equivalents falling within the spirit and scope of the invention.

DETAILED DESCRIPTION OF PREFERRED EMBODIMENT

Referring now more particularly to the drawings, there is shown an illustrative wall covering 10 comprising a plurality of panels 11 in accordance with the invention. The panels 11, which preferably are molded of thermoplastic material, are formed with a simulated stone and mortar design, typical of hand-laid stone masonry. The simulated stone 12 in this case is generally disposed in a plurality of parallel horizontal rows with the stones 12 being isolated from each other by simulated lines of mortar 14. The stones 12 protrude outwardly of the mortar lines 14, typical of hand-laid stone, and some of the simulated stones 12 in this instance have a width (i.e. a vertical dimension as viewed in FIG. 1), greater than other of the stones in the row. The simulated stone 12 has irregular outer surfaces consistent with natural stone, and the mortar lines 14 also have a waving, or undulating, non-planar naturally appearing outer surface configuration. While the invention has particular utility in panels formed with simulated masonry, such as hand laid stone or brick, it will be understood that the panels could be made with other forms of simulated building elements, such as shake shingles, tile, or the like.

Figure 3:
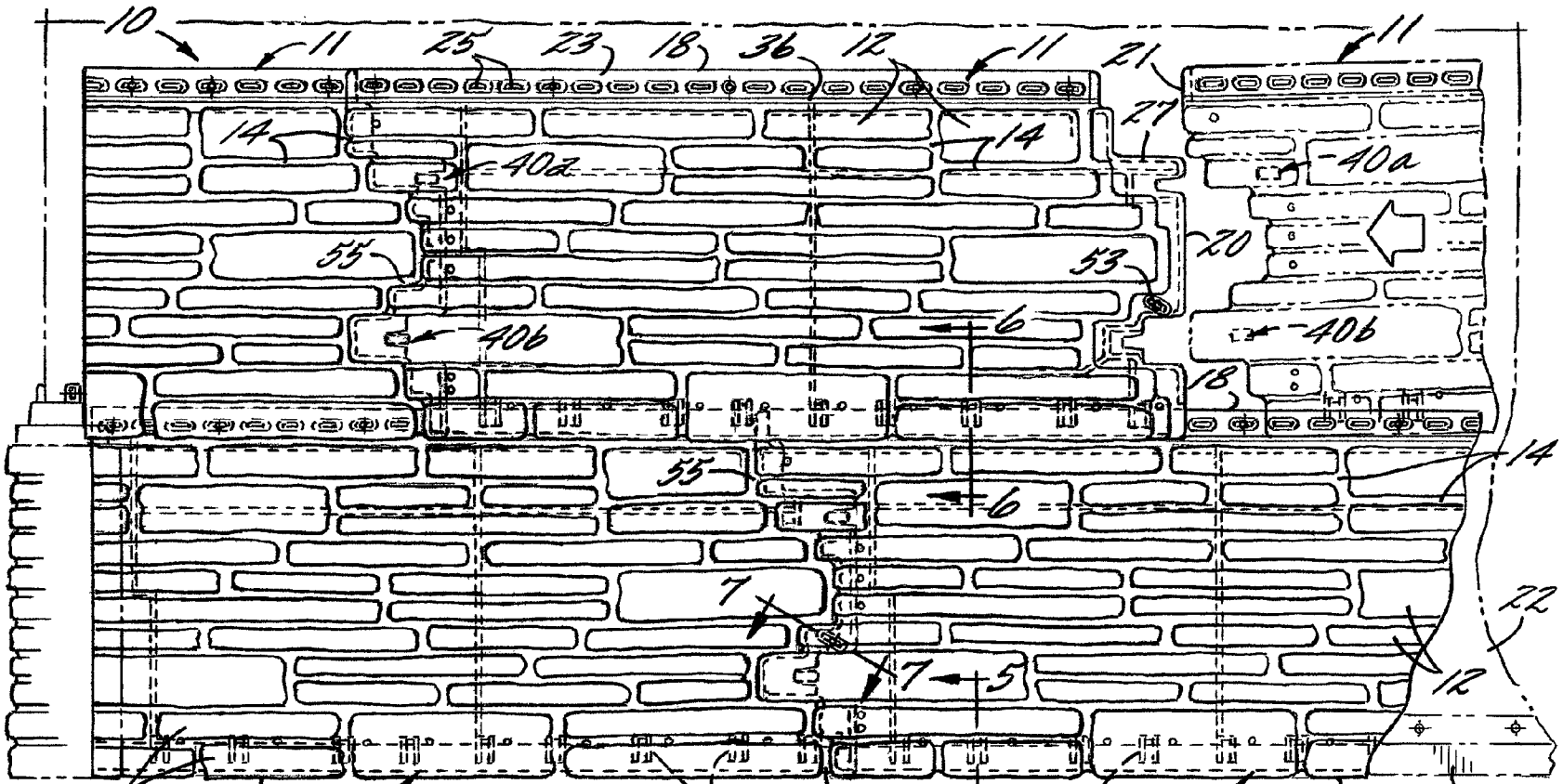
FIG. 3 is a plan view of a wall covering comprised of a plurality of wall panels shown in FIG. 1.
Figure 5:
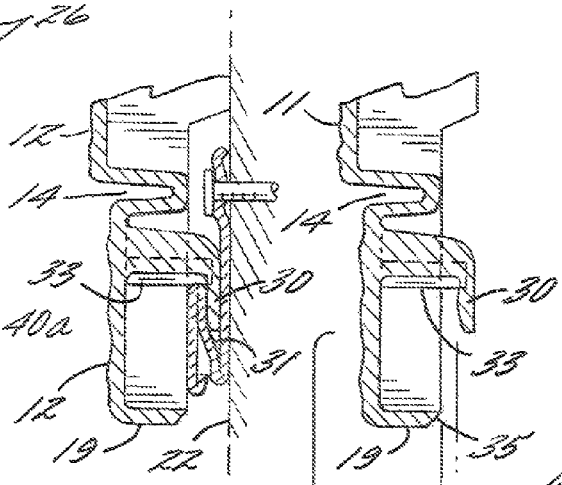
FIG. 5 is an enlarged fragmentary section of the engagement of a lowermost panel of the wall covering with a bottom starter strip, taken in the plane of line 5-5 in FIG. 3.

Each illustrated panel 11 has an upper horizontal marginal edge region 18 having a substantially uniform width extending across the top of the panel immediately above the top row of stone 12, a lower marginal edge region 19 which defines a lower peripheral edge of the simulated pattern, a side marginal edge region 20 located to the right-hand side of the last simulated stone 12 in each row, and a left side marginal edge region 21 on the opposite side of the panel 11. The left side marginal edge region 21 in this case is defined by the left hand edges of the stone in the respective rows, and the right marginal edge region 20 is defined by an irregular configured flange 27 that extends outwardly from the base of the stone at the right hand ends of the rows. The panels 11 are mounted on a support surface 22, which may be a wall of a house or other building structure, in horizontal courses with the right-side marginal edge region 20 in underlying relation to the left-side marginal edge region 21 of the panel immediately to the right thereof and with the lower marginal edge regions 19 of the panels in each course overlying the upper marginal edge regions 18 of the panels in a previously installed course immediately below. The panels 11 typically are mounted beginning with the left-hand panel of the lowermost course to be installed on the wall or roof, utilizing a bottom starter strip 31, as is known in the art (FIGS. 3 and 5). Upon completion of the first course, the second course is installed, immediately above the first course, again starting from the left-hand side.

Figure 2:
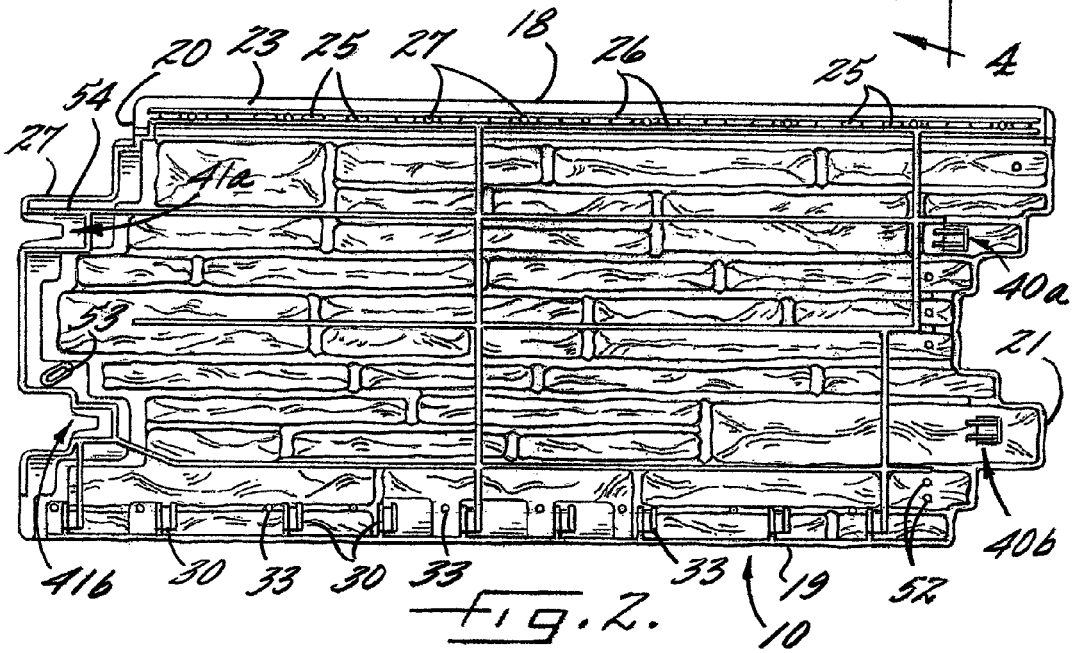
FIG. 2 is a rear plan view of the wall panel shown in FIG. 1.

For securing the panels 11 to the support surface 22, the upper marginal edge region 18 of each panel 11 has a mounting flange 23 parallel to the support surface 22 formed with a row of elongated laterally spaced nail or screw apertures 25. In order to provide firm support for the mounting flange 23 on the wall surface during fastening, the upper marginal edge region 18 in this instance is formed with a pair of rearwardly extending horizontal sealing flanges 26 which extend substantially the length of the upper marginal edge region 18 on top and bottom sides of the nailing apertures 25 (FIG. 2). For rigidifying the sealing flanges 26, circular posts 27 interconnect the sealing flanges 26 at spaced intervals along the upper marginal edge region 18 at locations between the nailing apertures 25.

Figure 4:
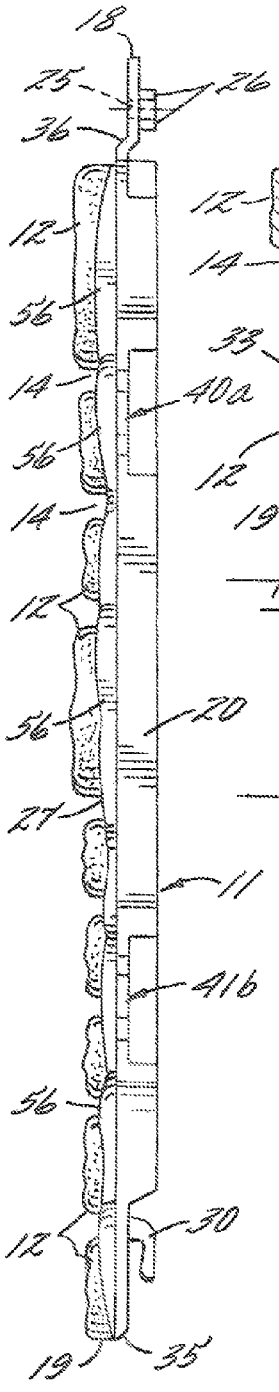
FIG. 4 is an enlarged right end view of the illustrated wall panel, taken in the plane of line 4-4 in FIG. 1.
Figure 6:
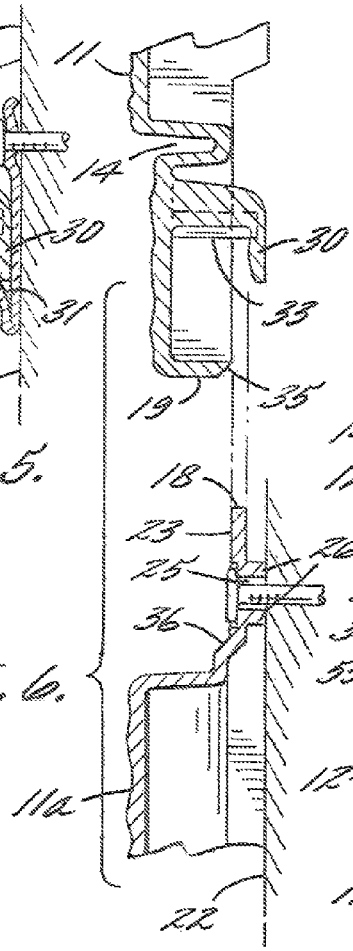
FIG. 6 is an exploded fragmentary section of upper and lower marginal edge regions of panels in adjacent courses, taken in the plane of line 6-6 in FIG. 3.
Figure 6A:
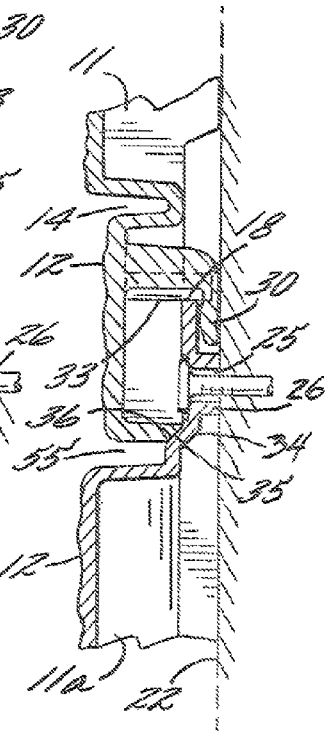
FIG. 6A is a fragmentary section similar to FIG. 6, showing the lower and upper marginal edge regions of the panels in engaged relation with each other.
Figure 7:
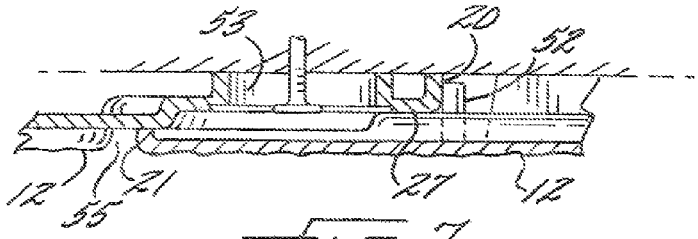
FIG. 7 is an enlarged fragmentary section of overlying side marginal edge regions of the wall cover, taken in the plane of line 7-7 in FIG. 3.
Figure 9:
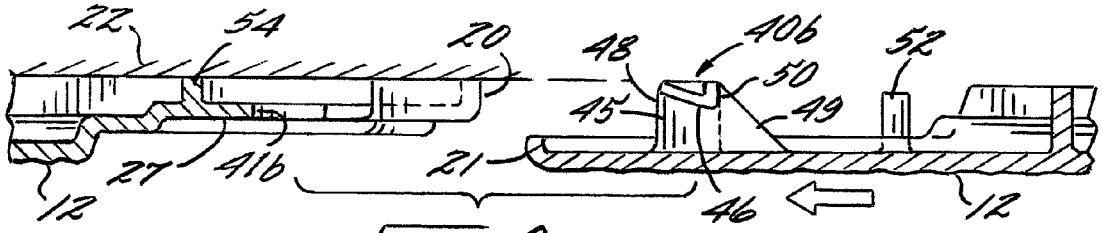
FIG. 9 is an enlarged fragmentary section taken in the plane of line 9-9 in FIG. 8.
Figure 9A:
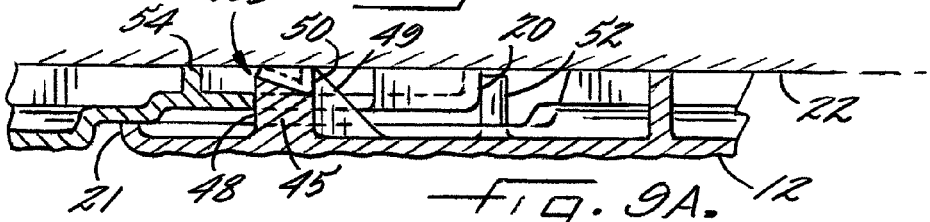
FIG. 9A is an enlarged fragmentary section, similar to FIG. 9, showing the side marginal edge regions in interengaged relation with each other.
Figure 10:
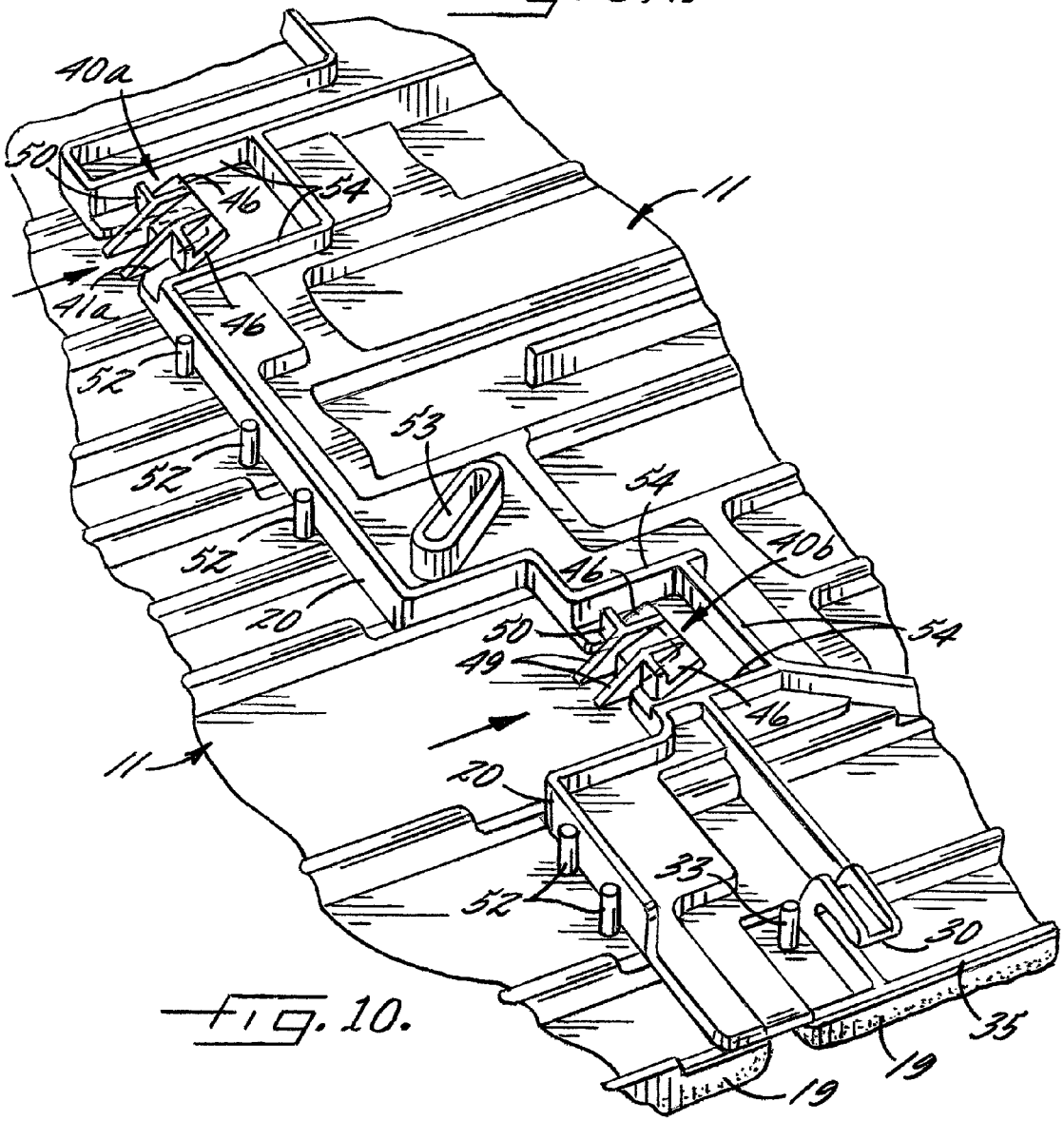
FIG. 10 is a fragmentary underside perspective of the interengaged side marginal edge regions of the illustrated wall covering.

In order to positively interlock the overlapping lower marginal edge region 19 of a panel 11 with an upper marginal edge region 18 of a previously mounted panel 11 when installing the next course of panels, each panel 11 is formed with a plurality of laterally spaced rearwardly and downwardly directed interlock flanges 30 on the underside of the lower marginal edge region 19 of the panel 11 (FIGS. 2-4), which are engageable with the upper marginal edge region mounting flange 23 of the previously mounted panel 11*a* supported in elevated parallel relation to the wall surface 22 by the sealing flanges 26 (FIGS. 6 and 6A). For locating the upper panel in predetermined overlying relation to the previously mounted panel 11*a*, while permitting thermal expansion and contraction of the panels in a vertical direction, frangible locating pins 33 extend rearwardly from the lower marginal edge region 19 which are positionable into abutting relation to the upper perimeter of the upper marginal edge region mounting flange 23 (FIGS. 2 and 6).

In order for the mortar lines 14 of adjacent top and bottom panels 11 to adjoin each other in coplanar closely adjacent relation such that the simulated stone 12 of each of the panels has a substantially uniform depth for a more natural and aesthetic appearance, the lower marginal edge region 19 of the overlying panel 11 is formed with a tapered seating surface 35 (FIGS. 6-6A) adapted for mating engagement with a tapered seating surface 36 of the upper marginal edge region 18 of the underlying panel 11, as disclosed in U.S. application Ser. No. 11/068,993, the disclosure of which is incorporated herein by reference. In the illustrated embodiment, the mounting flange 23 of the upper marginal edge region 18 is disposed in recessed relation to the plane of the mortar lines 14, being supported by a tapered wall 34 that defines the tapered seating surface 36 and the mortar line 14 adjacent to top row of simulated stone has a width substantially corresponding to the width of the mortar lines 14 throughout the panel. The tapered seating surface 35 of the overlying lower marginal edge region 19 intersects the sides of the stone 12 such that upon mating with the tapered seating surface 36 of the underlying panel, the depth of the simulated stone corresponds substantially to the depth of the simulated stone throughout the panels.

To enable mounting of the panels 11 in side-by-side relation with the junctures between adjacent panels less noticeable to the eye, the rows of stone 12 of each panel 11 extend in offset relation to each other so as to define staggered left and right-hand sides of the panel. Nevertheless, as indicated above, heretofore it has been difficult to mold such panels in a manner that enabled reliable inter-engagement of the overlying side marginal edge regions without unsightly or unnatural gaps between the simulated masonry of the adjacently mounted panels.

In accordance with an important aspect of the invention, the side marginal edge regions of adjacently mounted panels have an interlock arrangement which simultaneously aligns the panels during installation and which draws the side marginal edge regions into precise tight fitting relation that conceals the juncture between the adjoining panels and defines a naturally appearing mortar line between the simulated stone of the adjacent panels. To this end, the overlying left marginal edge region of each panel is formed with one or more depending hooks or standoffs that are engageable with respective outwardly opening slots in the underlying previously mounted panel which cooperate to align the overlying side marginal edge regions into precise relation to each other while simultaneously drawing the marginal edge regions into secure overlying engagement with each other. In the illustrated embodiment, the overlying left side marginal edge region 21 is formed with a pair of outwardly facing hooks 40*a*, 40*b* depending from an underside thereof, and the right side marginal edge region 20 is formed with a corresponding pair of outwardly opening hook receiving slots 41*a*, 41*b*. The hooks 40*a*, 40*b* are disposed at predetermined lateral distances from the left marginal edge 21 of the simulated stone 12, and the hook receiving slots 41*a*, 41*b* are correspondingly located and formed in the right marginal edge flange. The hook receiving slot 41*a* in this case is formed in the edge of the flange 27, and the hook receiving slot 41*b* is formed in a larger recess 44 of the flange laterally inwardly up the slot 41*a*.

The hooks 40*a*, 40*b* have a rigid construction, comprising a support section 45 fixed in depending relation to the underside of the left side marginal edge region 21 and a pair of wings 46 extending outwardly from opposite sides of the support section 45. The support sections 45 in this instance each have an end wall 48 facing the outer perimeter of the side marginal edge region 21 and a pair of support legs 49 extending rearwardly of the end wall 48, with the wings 46 each extending outwardly from a respective leg 49 of the support section 45. For added rigidity, the legs 49 extend in rearwardly of the wings 46 and a vertical reinforcing plate 50 interconnects each wing 46 to the respective support leg 49.

For supporting the right side marginal edge region flange 27 in elevated relation to the support surface 22 on which the panels 10 are mounted and for rigidifying the interengagement between the panels 10, the right side marginal edge region 20 is formed with pairs of parallel depending flanges 54 on opposite sides of the hook receiving slots 41*a*, 41*b* which in this case extend horizontally. For maintaining the support flanges 54 in secure engaged relation to the support surface prior to installation of the next panel, the right side marginal edge region panel 20 is formed with one or more nailing apertures 53. The nailing apertures 53 in this case have an elongated configuration oriented at an acute angle to the horizontal for facilitating multidirectional temperature expansion or contraction.

For aligning the rows of simulated stone 12 of one panel 10 with the rows of simulated stone on a previously mounted panel as an incident to engagement of the hooks 40*a*, 40*b* with the hook receiving slots 41*a*, 41*b* during installation, the hook receiving slots 41*a*, 41*b* have a V-shaped configuration that narrows in a direction inwardly toward the edge of the panel 10. For ease of installation, the hooks 40*a*, 40*b* may be positioned into the wide mouths of the slots 41*a*, 41*b*, and lateral advancement of the hooks 40*a*, 40*b* into the slots 41*a*, 41*b* will simultaneously move the panel into aligned relation to the previously mounted panel. To facilitate such interengagement and alignment, the depending legs 49 of the hook support section 45 in this case also are angled with respect to each other in a general V configuration.

For drawing the side marginal edge regions 20, 21 firmly together as the overlying left marginal edge region 21 is moved into mating engagement with the previously mounted panel 10, the wings 46 are inclined at an acute angle to the substantially horizontal plane of the panel with a trailing end of each wing 46 being disposed more closely to the underside of the panel. It can be seen, therefore, that as the hooks 40*a*, 40*b* enter the respective slots 41*a*, 41*b* the leading edges of the wings 46 move under the right marginal edge region flange 27 with the taper of wings 46 drawing the side marginal edge regions into tight close-fitting relation with each other, as the sides of the V-shaped openings 41*a*, 41*b* simultaneously guide the hooks 40*a*, 40*b* into lateral aligned relation with the previously mounted panel such that the rows of simulated masonry of the adjacent panel, are directed into properly aligned relation to each other. For locating the left side marginal edge region 21 in predetermined overlying relation to the previously mounted panel, while permitting thermal expansion and contraction of the panels 20 in a horizontal direction, frangible locating pins 52 depend from the underside of the left side marginal edge region 21 which are engageable by the right side marginal edge region flange 27.

By virtue of the foregoing side interlock arrangement of the panels 10, it can be seen that the rows of simulated stone 12 of adjacent panels can be securely and precisely located with a gap corresponding in size to that of the mortar lines 14 throughout the panels. It will be appreciated by one skilled in the art that the side alignment and locking feature may be efficiently and reliably produced by plastic injection molding. Since the side interlocks do not require a small slot or groove under the masonry building element, typical of the prior art, they may be produced without thin plate tooling that can be susceptible to warpage or breakage.

In keeping with a further aspect of the invention, the gaps between rows of simulated masonry of adjacent panels is defined by a non-planar or undulating mortar line 55 consistent with the mortar lines 14 throughout the panels, which further conceals the juncture between the panels 12 and which facilitates the interengagement of the panels at that juncture. In the illustrated embodiment, the right side marginal edge region flange 27 is formed with a slightly raised pad 56 adjacent to the periphery of the right hand ends of the simulated stone of each row, which has a non-planar undulating surface corresponding to that of the mortar lines 14 throughout the panel. The overlying left side marginal edge region 21 of each panel 10 further is formed with an undulating surface 58 complementing the surface of the pad 56. Mating of such corresponding and conforming undulating surfaces 56, 58 enable tight interfitting of the engagement panels without unsightly gaps between the mating side marginal edge regions. Instead, the mortar lines defined by the pad 56 closely follows the edges of the simulated stone 12 defined by the left side marginal edge 21 of the overlying panel and further enhance the interengagement of the overlying side marginal edge regions.

In keeping with the invention, the simulated masonry has a textured outer surface more characteristic of natural stone or brick. To this end, following molding of the plastic panels, the panels are coated with a paint mixed with suspended sand-like particles. The particles may be made of natural or man-made materials, preferably sized between 0.020 and 0.200 inches. The paint and particle mixture, which may be mixed with a suitable solvent as necessary, may be sprayed by conventional spray guns. As is known in the art, the outer faces of the stone and the separating mortar lines may be separately painted with different colors for the particular application. It will be appreciated by one skilled in the art that the resulting roughened textured surface of the simulated masonry will more closely resemble, both in appearance and feel, natural hand laid masonry.

From the foregoing, it can be seen that a wall covering is provided that comprises plastic injection molded panels formed with rows of simulated masonry that can be efficiently installed with a more aesthetic and natural appearance. The spacing and alignment of simulated stone or brick of adjacently mounted panels can be more tightly and precisely controlled for a more natural appearance. The gaps between masonry of adjacently mounted panels, furthermore, is defined by mortar lines consistent with the mortar lines separating the stone or brick masonry throughout the panels. The simulated masonry further has a textured surface appearance more characteristic of natural stone or brick. Yet, the wall panels further are adapted for economical manufacture and more robust interlocking of overlapping side marginal edge regions of the panel.

The invention claimed is:

1. A wall covering for mounting on a support surface comprising:

a plurality of panels each having a body portion formed with a plurality of horizontal rows of simulated building elements;

said panels each having upper and lower elongated marginal edge regions and opposite first and second side marginal edge regions, said panels having a vertical axis extending from the lower marginal edge region to the upper marginal edge region; and said panels having a front surface and a rear surface;

said panels being mountable on said support surface in a plurality of horizontal courses with said panels in a first horizontal course having a lower marginal edge region overlying an upper marginal edge region of previously mounted panels in a second horizontal course positioned below the first horizontal course, and with said panels in each horizontal course having a first side marginal edge region overlying a second side marginal edge region of an adjacent previously mounted panel in the same horizontal course;

said upper and lower marginal edge regions having interengageable interlocks for positively securing together overlying upper and lower marginal edges regions;

said first side marginal edge region of each panel being formed with a substantially T-shaped hook projecting rearward from the rear surface of the panel, said hook having a center post molded integrally with the panel and protruding out therefrom, the center post having a width in the direction of the vertical axis, said hook including at least two wings molded onto and extending outward from the center post at a point spaced apart from the rear surface of the panel, the wings extending from the post substantially along the vertical axis such that the wings extend generally parallel to and spaced apart from the rear surface of the panel, and said second side marginal edge region of each panel being formed with a hook receiving slot, said slot extending from the front surface through the rear surface and formed with an opening in the second side marginal edge and so as to permit passage into the slot from the side of the panel, the slot having a width in the direction of the vertical axis that is sized to receive the center post of a corresponding hook in an adjacent panel, and said hook and slot of adjacent panels being interengageable as an incident to relative lateral movement of the panels during installation such that the first side marginal edge region overlies the second side marginal edge region with the rows of simulated building elements of one panel in aligned and predetermined spaced relation to the rows of simulated building elements of the adjacently mounted panel, and wherein the interengagement of the hook and the slot results in the center post of the hook being positioned between opposite sides of the slot, and the wings overlying and in contact with portions of rear surface of the underlying panel thereby securing the underlying panel to the overlying panel.

2. The wall covering of claim 1 in which said slot and hook of each panel have cooperating surfaces for laterally aligning the rows of simulated building elements of one panel with the rows of simulated building elements of the adjacent panel as an incident to lateral movement of the overlying first side marginal edge region during installation on the support surface.

3. The wall covering of claim 1 in which said hook and slot of each panel have cooperating surfaces for drawing the overlying first side marginal edge regions of adjacent panels together into tight fitting engagement with each other as an incident to relative lateral movement during installation on said support surface.

4. The wall covering of claim 1 in which said underlying second side marginal edge region of each panel is formed with an elongated nailing aperture oriented at an angle to the elongated upper marginal edge region.

5. The wall covering of claim 4 in which said underlying second side marginal edge region of each panel is formed with a pair of depending support flanges extending rearward from the rear surface of the panel on opposite sides of said slot which are positioned so as to contact said support surface.

6. The wall covering of claim 1 in which said panels are formed with rows of simulated hand laid masonry items with simulated mortar lines separating the masonry items throughout the panel, said masonry items projecting outward from said simulated mortar lines, said simulated mortar lines having an undulating non-planar outer surface, said underlying second side marginal edge region of each panel being formed with a side flange extending laterally from the last simulated masonry items of each row, said side flange having a first portion defining a first substantially planar front surface of the panel, the slot being formed in the first portion of the side flange, and a second portion defining a second front surface of the flange, the second portion having a non-planar undulating surface similar to that of the masonry lines throughout the panel.

7. The wall covering of claim 6 in which said overlying first side marginal edge region of each panel is formed with a non-planar undulating surface complementary to the undulating surface of said side flange which is positionable onto the undulating surface of said side flange as an incident to interengagement of the overlying first side marginal edge regions.

8. The wall covering of claim 1 in which said first side marginal edge region of each panel is formed with a plurality of said hooks, and said second side marginal edge region is formed with a respective plurality of said hook receiving slots.

9. The wall covering of claim 8 in which said hooks of each panel are located in laterally offset relation to each other, and said hook receiving slots of each panel are located in laterally offset relation to each other similar to said hooks.

10. The wall covering of claim 8 in which said hook receiving slots each have an outwardly opening substantially V-shaped configuration that tapers from the edge of the panel inward for guiding said hooks into predetermined centered relation to the slots as an incident to relative lateral movement of the panels during installation of the panels on said support surface.

11. The wall covering of claim 1 in which said first side marginal edge region of each panel has a plurality of frangible locating pins extending rearward from the rear surface of the panel for engaging and locating the first side marginal edge region in predetermined relation to the underlying second side marginal edge region of a previously mounted panel.

12. A wall covering for mounting on a support surface comprising:

a plurality of panels each having a body portion formed with a plurality of horizontal rows of simulated hand laid masonry elements with simulated mortar lines separating the masonry elements throughout the panel, said simulated mortar lines having an undulating non-planar outer surface;

said panels each having upper and lower marginal edge regions and opposite first and second side marginal edge regions, said panels being mountable on said support surface in a plurality of horizontal courses with said panels in a first horizontal course having a lower marginal edge region overlying an upper marginal edge region of a previously mounted panel in a second course positioned below the first horizontal course and with said panels in each course having a first side marginal edge region overlying a second side marginal edge region of an adjacent previously mounted panel in the course, said upper and lower marginal having interengageable interlocks for positively securing together overlying upper and lower marginal in mounted position;

said overlapping side marginal edge regions having interengageable interlocks for positively securing the overlying side marginal edge regions together, the interengageable interlocks on the overlapping side marginal edge regions including a first interlock component on one panel and a second interlock component on the other panel; and said underlying side marginal edge region of each panel being formed with a side flange extending outwardly of the last simulated masonry element of each row, and said side flange having a first portion defining a first substantially planar front surface of the panel, one of either the first or second interlock components being formed in the first portion of the side flange, and said side flange having a second portion defining a second front surface of the flange, the second portion having a non-planar undulating surface adjacent the simulated masonry element at the end of each row similar to that of the masonry lines throughout the panel, wherein said first side marginal edge region of each panel includes the first interlock component which is a hook extending from a rear surface of the panel and said second side marginal edge region of each panel includes the second interlock component which is an outwardly opening hook receiving slot, and said hook and hook receiving slot of adjacent panels being interengageable as an incident to relative lateral movement of the panels during installation such that the first side marginal edge region overlies the second side marginal edge region with the rows of simulated building elements of one panel in aligned and predetermined spaced relation to the rows of simulated building elements of the adjacently mounted panel, and wherein said panels having a vertical axis extending from the lower marginal edge region to the upper marginal edge region, and wherein the hook is a substantially T-shaped hook projecting rearward from a rear surface of the panel, said hook having a center post molded integrally with the panel and protruding out therefrom, the center post having a width in the direction of the vertical axis, said hook including at least two wings molded onto and extending outward from the center post at a point spaced apart from the rear surface of the panel, the wings extending from the post substantially along the vertical axis such that the wings extend generally parallel to and spaced apart from the rear surface of the panel, and wherein the hook receiving slot is formed with an opening in the second side marginal edge so as to permit passage into the slot from the side of the panel, the slot having a width in the direction of the vertical axis that is sized to receive the center post of a corresponding hook in an adjacent panel.

13. The wall covering of claim 12 in which said overlying first side marginal edge region of each panel is formed with a non-planar undulating surface complementary to the undulating surface of said side flange which is positionable onto the undulating surface of said side flange as an incident to engagement of the overlying first side marginal edge regions.

14. A wall covering of claim 2 further comprising: said building elements having an outer coating with small-sized particulate matter for providing the masonry element with a roughened textured outer surface.

15. The wall covering of claim 14 in which said coating is a paint with mixed small sized particles.

16. The wall covering of claim 15 in which said particles have a size of between 0.020 and 0.200 inches.

17. The wall covering of claim 6 wherein the second portion of the flange undulates forwardly from a plane defined by the first portion of the flange.

18. The wall covering of claim 6 wherein the first portion of the flange is located laterally to a side of the second portion of the flange.

* * * * *